US005699072A

United States Patent [19]

Tokuda et al.

[11] Patent Number: 5,699,072

[45] Date of Patent: Dec. 16, 1997

[54] FEED-HORN WITH HELICAL ANTENNA ELEMENT AND CONVERTER INCLUDING THE SAME

[75] Inventors: Katsuhiko Tokuda; Yoshikazu Yoshimura, both of Osaka, Japan

[73] Assignee: Matsushita Electric Industrial Co., Ltd., Osaka, Japan

[21] Appl. No.: 654,458

[22] Filed: May 28, 1996

[30] Foreign Application Priority Data

May 29, 1995 [JP] Japan ..... 7-130107

[51] Int. Cl.[6] ..... H01Q 13/02

[52] U.S. Cl. ..... 343/786; 343/872; 343/895

[58] Field of Search ..... 343/895, 789, 343/786, 872; H01Q 13/00, 13/02

[56] References Cited

U.S. PATENT DOCUMENTS

| | | | |
|---|---|---|---|
| 3,526,897 | 9/1970 | Cribb | 343/895 |
| 4,412,222 | 10/1983 | Möhring | 343/779 |
| 4,442,437 | 4/1984 | Chu et al. | 343/786 |
| 4,622,559 | 11/1986 | Shafai et al. | 343/786 |
| 4,672,388 | 6/1987 | Grim | 343/786 |
| 4,758,841 | 7/1988 | Grim | 343/786 |
| 4,797,681 | 1/1989 | Kaplan et al. | 343/786 |
| 4,929,962 | 5/1990 | Begout et al. | 343/786 |
| 5,229,736 | 7/1993 | Adams et al. | 333/21 A |
| 5,453,755 | 9/1995 | Nakano et al. | 343/895 |

FOREIGN PATENT DOCUMENTS

| | | |
|---|---|---|
| 0 136 818 | 4/1985 | European Pat. Off. . |
| 0 577 320 | 1/1994 | European Pat. Off. . |
| WO 87/03143 | 5/1987 | Japan . |
| 1 291 530 | 10/1972 | United Kingdom . |
| 1 560 471 | 2/1980 | United Kingdom . |
| 2 150 358 | 6/1985 | United Kingdom . |

OTHER PUBLICATIONS

Patent Abstracts of Japan, vol. E 773, No. 3, JP 1–53608(A) Mar. 1989.

Patent Abstracts of Japan, vol. E 1288 No. 77, JP 4–200104(A) Jul. 1992.

*Primary Examiner*—Michael C. Wimer

*Attorney, Agent, or Firm*—McDermott, Will & Emery

[57] ABSTRACT

The feed-horn with helical antenna element of this invention comprises (1) a waveguide made of conductive cylinder having a step inside, the inner diameter in the vicinity of the opening face of the waveguide is larger than that of the base of the waveguide, and (2) a helical antenna element disposed at the base axial center of the waveguide. Introduction of the step-formed inside to the waveguide makes it possible to obtain excellent characteristics both of cross polarization and impedance.

8 Claims, 10 Drawing Sheets

FEED-HORN WITH HELICAL ANTENNA ELEMENT AND CONVERTER INCLUDING THE SAME

BACKGROUND OF THE INVENTION

The present invention relates to a feed-horn with a helical antenna element converting a circular polarization mode into a coaxial mode in microwave bandwidth, and a converter including this feed-horn with a helical antenna element.

One of a conventional feed-horn with a helical antenna element used in microwave bandwidth is, for example, described in the Japanese laid-open gazette H4-200104. This conventional feed-horn with helical antenna element, of which cross-section is shown in FIG. 13, includes a cup-shape waveguide 50 tapering from an opening 51 to a base 52, accordingly the inner diameter also tapers from the opening 51 to the base 52. A helical element 60 is disposed on the base 52, and a cap 70 made of a dielectric material for closing the opening 51 is disposed thereon.

A variation of this conventional feed-horn with a helical antenna element is depicted in FIG. 14. In this case, the deeper part 53 of the waveguide 50 has a specified length and diameter and forms a cylinder, and thereby a conductive condition around the helical element 60 is fixed so that a desired directivity can be obtained.

Other variations depicted in FIG. 15 and FIG. 16 are also known. They have convex caps 71 and 72 extruded from the opening to outside.

A low noise block down-converter using such a feed-horn with a helical antenna element is shown in FIG. 17. The feed-horn with a helical antenna element of the converter is mounted to a rack 82. A printed circuit substrate 81, on which surface a microstrip line 80 constituting a converter circuit is formed, is mounted to this rack 82. The microstrip line 80 is soldered to a straight-line segment 61 of the helical element 60.

The helical element has been known to have an excellent cross polarization characteristic across a broad band width. However, as shown in FIG. 13 and FIG. 14, when the helical element 60 is mounted into the waveguide 50 made of conductive materials, the characteristic is deteriorated, thereby a desired cross polarization characteristic cannot be obtained. When the feed-horn with a helical antenna element shown in FIG. 13 is used, a distance between the cap 70 and the helical element 60 varies gradually in response to a change of the opening diameter. Thus, at a certain position having a certain opening diameter, where a desired directivity are supposed to be obtained, it is not possible to obtain an excellent impedance-matching with space and cross polarization characteristic. The helical element 60 is thus have to be changed in shape. When varying the taper angle under the fixed opening diameter of waveguide 50, a matching condition between the helical element 60 and the inside of waveguide 50 is deteriorated, thereby the desired characteristics cannot be obtained. When using the feed-horn with a helical antenna element shown in FIG. 14, the cylindrical deeper part 53 of waveguide 50 should have an enough length in order to maintain a constant matching condition between the helical element 60 and an inner shape of the waveguide 50 as well as to obtain the desired directivity. As a result, an overall length of the feed-horn is obliged to become longer.

When the feed-horn with a helical antenna element shown in FIG. 15 and FIG. 16 is used, the convex caps 71 and 72 can improve the impedance-matching between space and helical element 60 as well as cross polarization characteristic. However, the cap 71 and 72 must be extruded from the opening face, and they must be kept away by certain distances from the helical element 60 to avoid influence from the helical element 60. As a result, the overall length of the feed-horn becomes longer.

When the converter shown in FIG. 17 is used, the helical element 60 is fed from the rear side of the printed circuit substrate 81. For this feeding purpose, a straight-line segment 61 of helical element 60 is joined at a right angle to the micro-strip line 80. This means the feed-horn with a helical antenna element 60 is joined at L shape with the converter circuit. The total dimension of the converter thus becomes larger.

SUMMARY OF THE INVENTION

The present invention is to provide the smaller size feed-horn with a helical antenna element which optimizes characteristics such as impedance-matching with space and cross polarization characteristic, and to provide the smaller size converter using the smaller feed-horn with a helical antenna element.

One of embodiments of the present invention comprises (1) a waveguide having a step-formed conductive cylinder of which diameter in the vicinity of the opening is larger than the diameter in the vicinity of the base, and (2) helical antenna element mounted to the base axial center of the waveguide.

Another embodiment has an inductive cap concaved toward the base of waveguide, and the cap closes the opening of the waveguide.

Yet another embodiment has a ring-wise groove around the opening face of the waveguide.

The converter of the present invention comprises (1) the above mentioned feed-horn with a helical antenna element, and (2) a micro-strip line disposed on a printed circuit substrate, electrically connected to a straight-line-segment.

DESCRIPTION OF THE PREFERRED EMBODIMENTS

Figure 1:
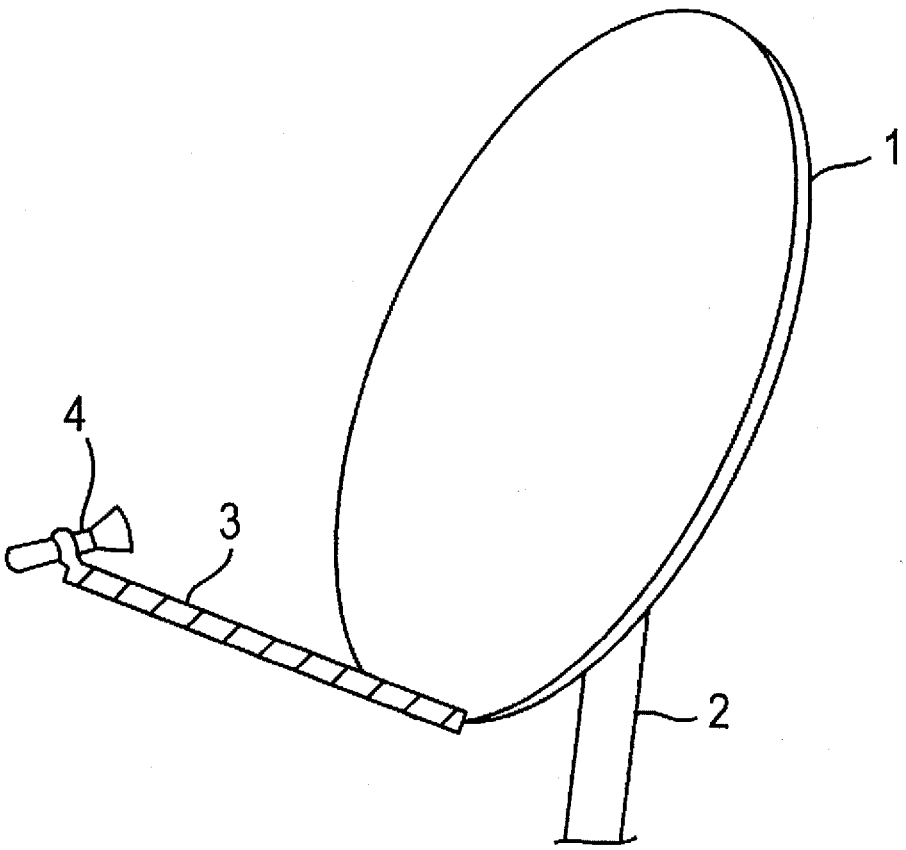
FIG. 1 is a perspective view of a satellite broadcast receiving apparatus used in the embodiments of the present invention.

FIG. 1 is a perspective view of a satellite broadcast receiving apparatus used in the embodiments of the present invention. The satellite broadcast receiving apparatus comprises a parabolic reflector 1 mounted to a pole 2, and a converter 4 mounted to the reflector 1 via an upholding arm 3. The converter 4 integrates the feed-horn with a helical antenna element of the present invention and a converter circuit.

Embodiment 1.

Figure 2:
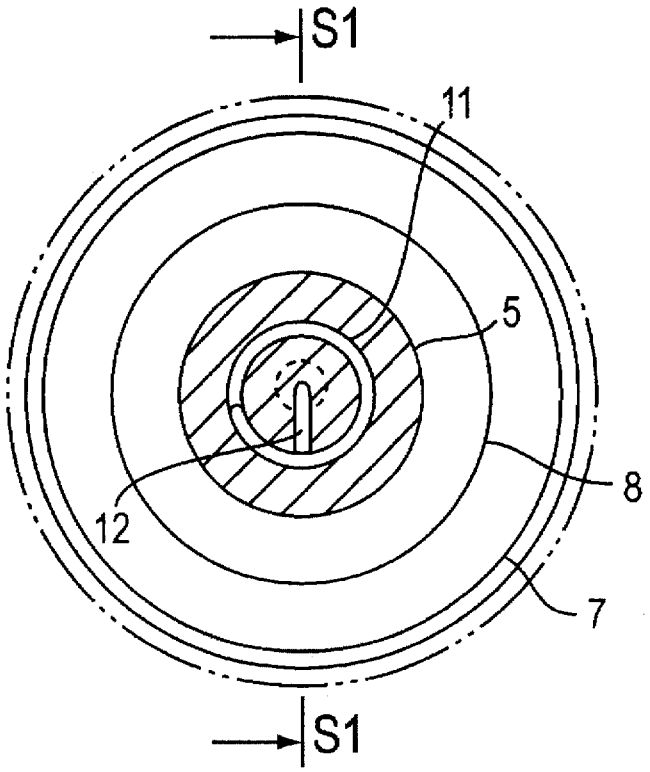
FIG. 2 is a top view of a feed-horn with a helical antenna element used in embodiment 1 of the present invention.
Figure 3:
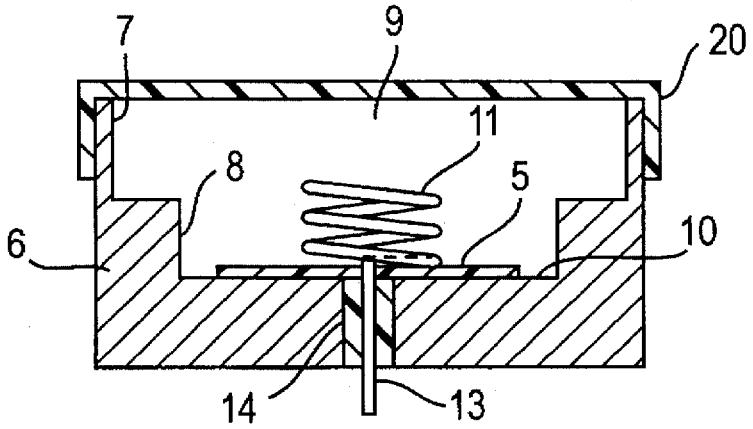
FIG. 3 is a cross section of the feed-horn with a helical antenna element shown in FIG. 2 with a cutting-plane line S1—S1.

The feed-horn with a helical antenna element shown in FIG. 2 and FIG. 3 uses a waveguide 6 having step-formed inside, in other words, a first cylinder part 7 having a larger inner diameter is disposed at the opening 9 and a second cylinder part 8 having a smaller inner diameter is disposed at the base 10. A coil-spring helical antenna element 11 is disposed on the center of the base 10 inside of the second cylinder 8 via a dielectric spacer 5 having specified diameter and thickness. A straight-line segment 13 extended from a bent segment 12 of the helical element 11 is inserted into a dielectric supporter 14 (coaxial circuit) disposed at the center of base 10, and the straight-line segment 13 is thus supported. The opening 9 is closed with the dielectric cap 20.

In this embodiment, since the first cylinder 7 has a larger diameter than that of the second cylinder 8, influence given by the first cylinder 7 to the helical element 11 can be reduced. As a result, the cross polarization characteristic gained by the second cylinder 8 and the helical element 11 can be maintained at an excellent level. An excellent impedance-matching between space and the feed-horn with a helical antenna element can be also obtained.

When this feed-horn with a helical antenna element is incorporated into a converter, the straight-line segment 13 of the helical element 11 is soldered to the micro-strip line (not shown). The circular polarization mode in the helical element 11 is converted, first, into the coaxial mode and then into the micro-strip circuit mode.

Embodiment 2.

Figure 4:
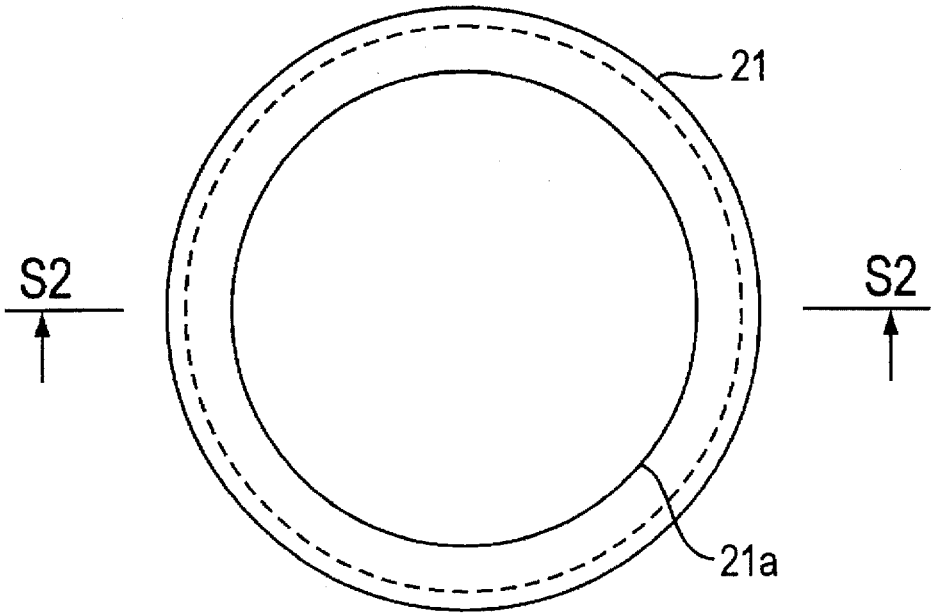
FIG. 4 is a top view of a feed-horn with a helical antenna element used in embodiment 2.
Figure 5:
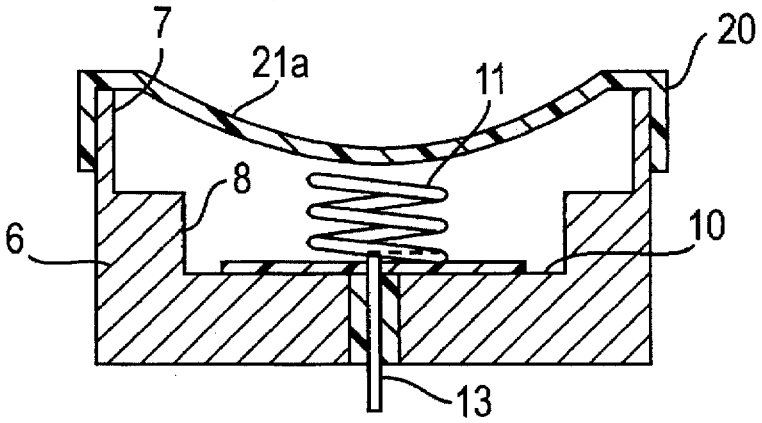
FIG. 5 is a cross section of the feed-horn with a helical antenna element shown in FIG. 4 with a cutting-plane line S2—S2.

The feed-horn with a helical antenna element shown in FIG. 4 and FIG. 5 has a dielectric cap 21 instead of the dielectric cap 20 shown in FIG. 2 and FIG. 3. The cap 21 is concaved toward the base 10. The concaved face 21*a* can help further improve the impedance characteristic without affecting the cross polarization characteristic and directivity. Since the cap 21 does not extrude upward, the height of feed-horn with a helical antenna element can be reduced, which lessens the overall size.

Figure 6:
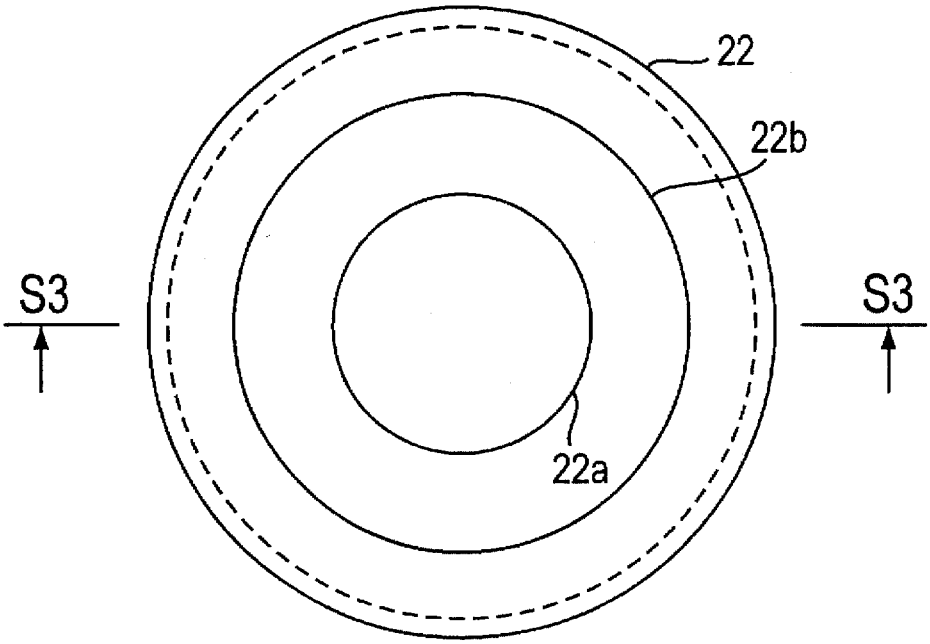
FIG. 6 is a top view of a cap used in embodiments of the present invention.
Figure 7:
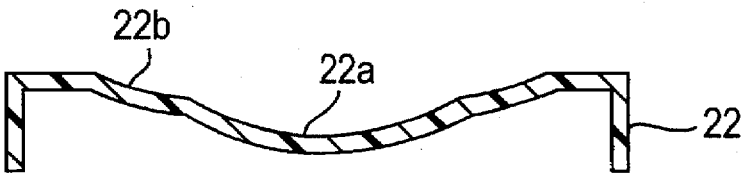
FIG. 7 is a cross section of the cap shown in FIG. 6 with a cutting-plane line S3—S3.

A cap 22 shown in FIG. 6 and FIG. 7 can be used instead of the cap 21. The cap 22 has a multi-level concaved faces including a first concave face 22*a* and a second concave face 22*b*. Both faces are concaved toward the base 10, and have different radius curvatures. The impedance characteristic can be fine adjusted by using the cap 22.

Embodiment 3

Figure 8:
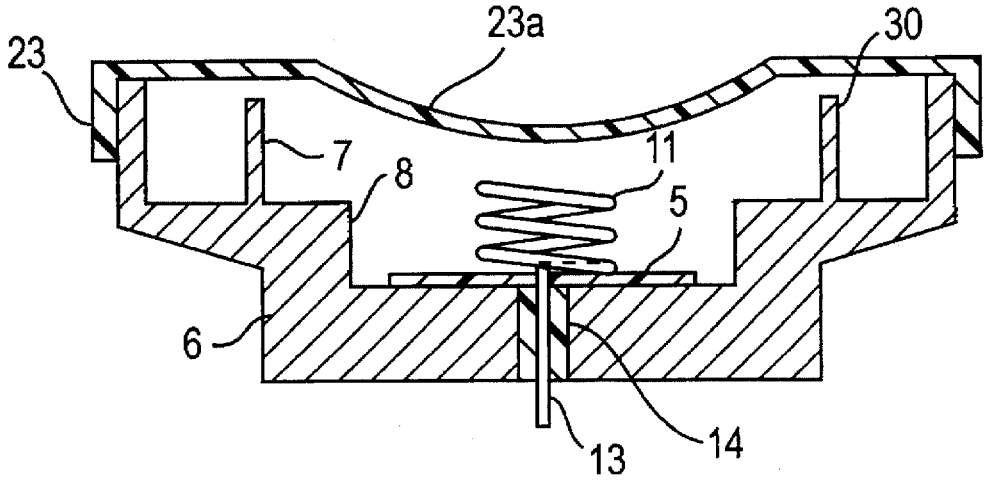
FIG. 8 is a cross section of the feed-horn with a helical antenna element used in embodiment 3.

A feed-horn with a helical antenna element shown in FIG. 8 is a variation of Embodiment 2. In this embodiment, a ring-wise corrugated circuit which forms "U" shape groove 30 is disposed in the outer circumference of the first cylinder 7. This structure makes it possible to adjust the directivity considering a matching with the parabolic reflector 1. This feed-horn with a helical antenna element employs a cap 23 having a concaved face 23*a* toward the opening face 9.

Figure 9:
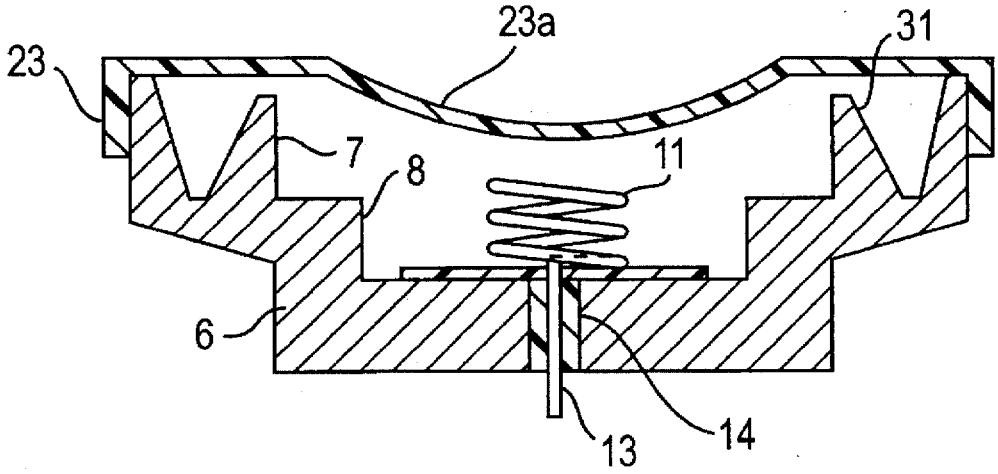
FIG. 9 is a cross section of another feed-horn with a helical antenna element used in embodiment 3.

Instead of the ring-wise groove 30 in the shape of "U", a ring-wise groove 31 in the shape of "V" shown in FIG. 9 can be used. In other words, a width of the groove narrows along the depth of groove. In this case, a shape of the cap closing the opening face 9 needs not to be changed for fine adjusting of the directivity, and also the directivity can be fine adjusted independently both of the impedance characteristic and cross polarization characteristic. Accordingly, the desired directivity proper to a reflector of the parabolic antenna can be obtained while maintaining excellent cross polarization characteristic and impedance characteristic.

The cross sectional shape of the ring-wise groove is not necessarily "U" or "V" shape, and it may take other shapes.

Embodiment 4

Figure 10:
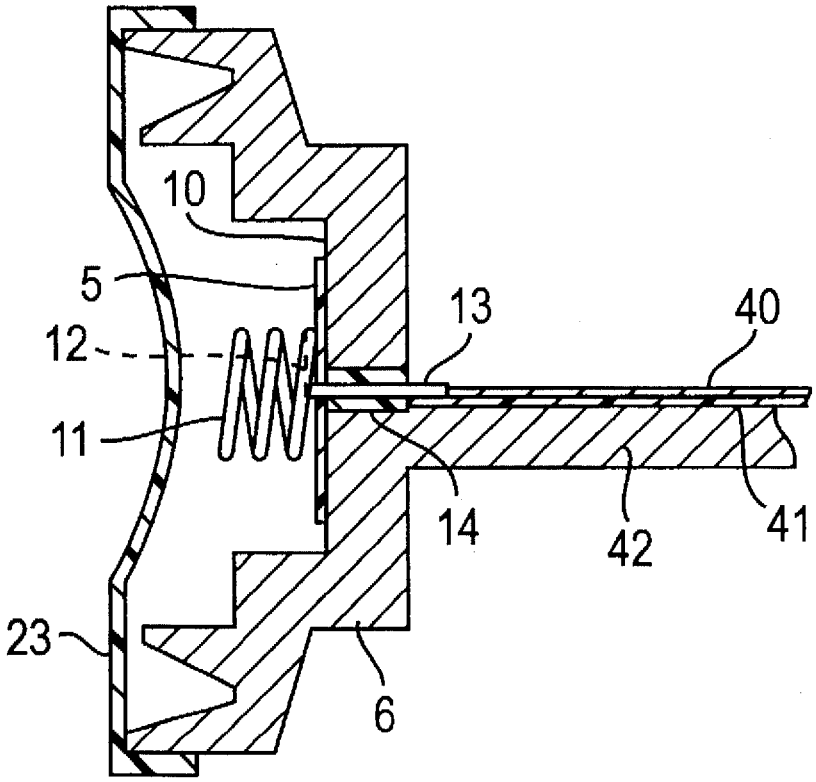
FIG. 10 is a cross section depicting the connection between the feed-horn with a helical antenna element and the converter circuit in embodiment 4 of the present invention.

FIG. 10 depicts a converter incorporating the feed-horn shown in FIG. 9. In order to gain an excellent matching with a high frequency circuit constituting the converter, the helical element 11 is disposed on the base 10 of the feed-horn of helical antenna element via a dielectric disk spacer 5 having a specified thickness. The straight-line segment 13 of helical element 11 and a dielectric supporter 14 form a coaxial circuit. The straight-line segment 13 of helical element 11 is soldered to the microstrip line 40 to form one straight line.

Figure 11:
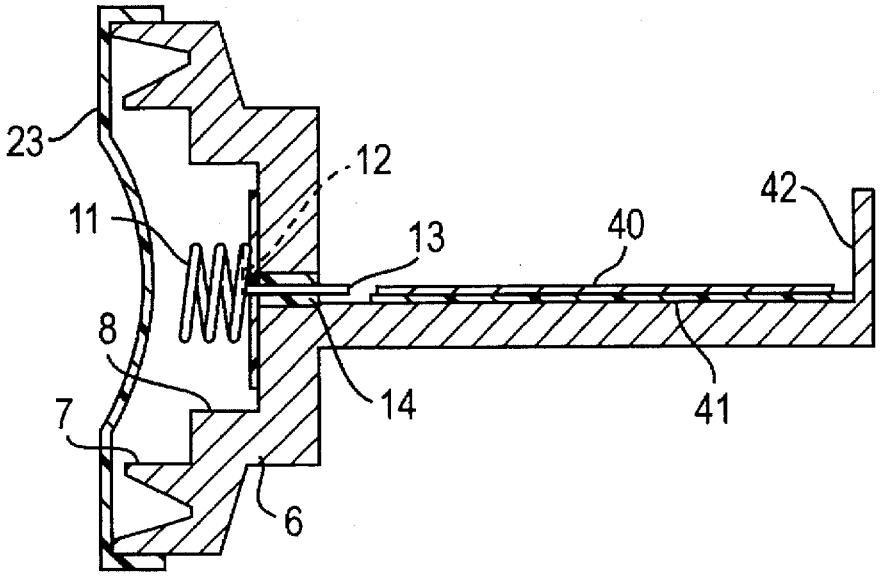
FIG. 11 is a cross section of embodiment 4 being ready for receiving the converter circuit.
Figure 12:
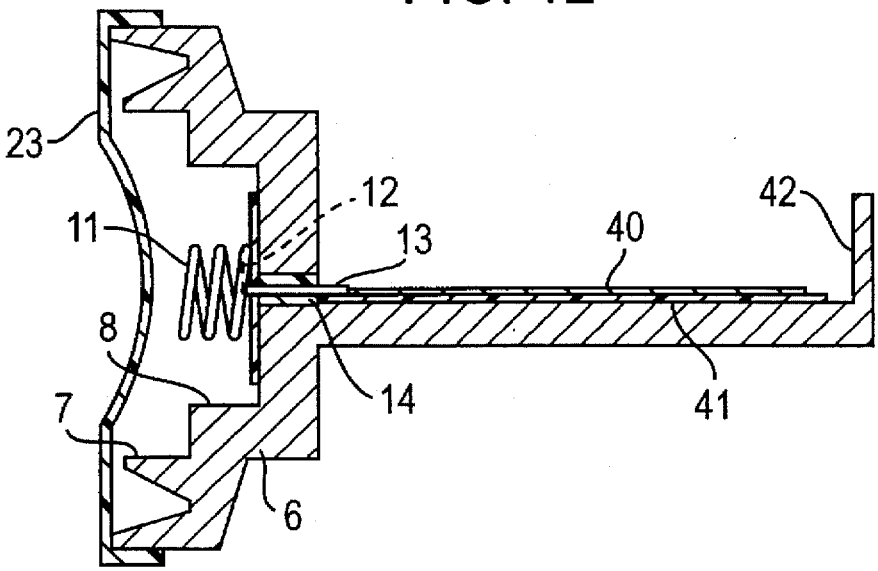
FIG. 12 is a cross section of embodiment 4 where the converter circuit is mounted.
Figure 13:
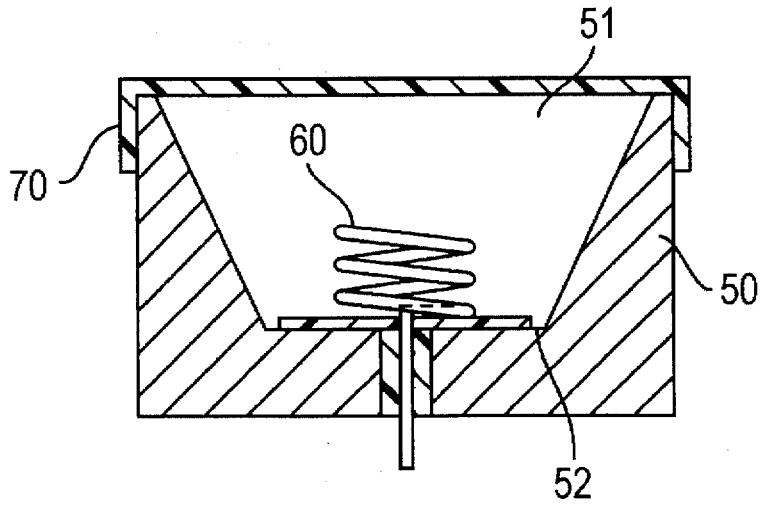
FIG. 13 through FIG. 16 are cross sections of conventional feed-horns with a helical antenna elements respectively.
Figure 14:
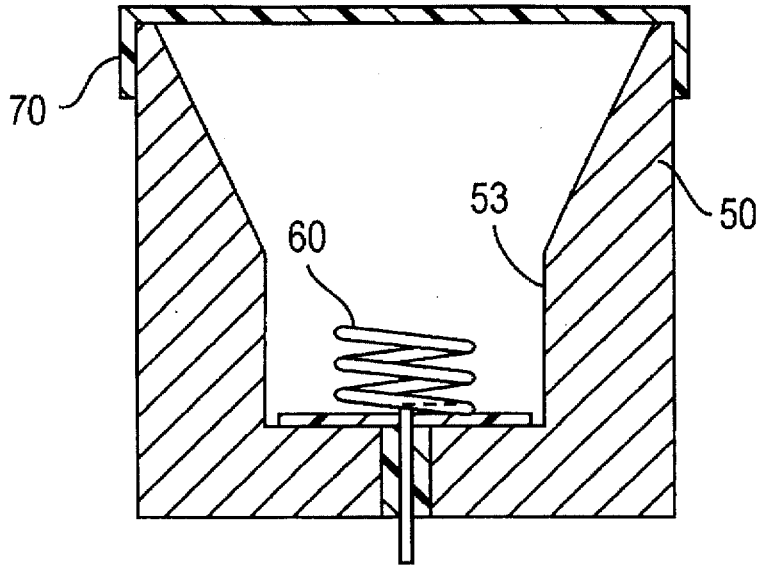
Figure 15:
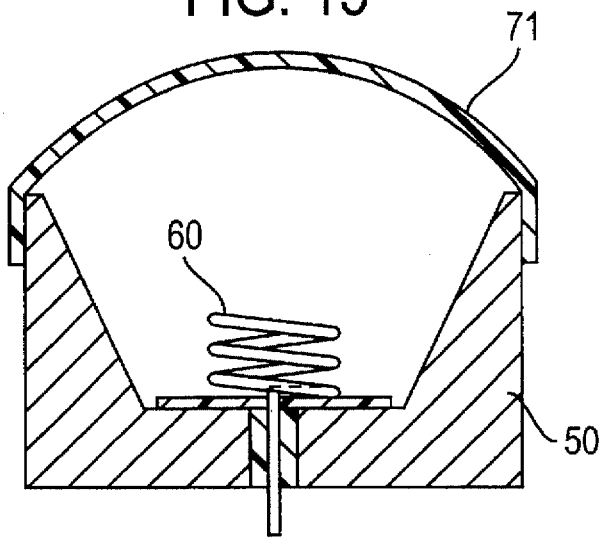
Figure 16:
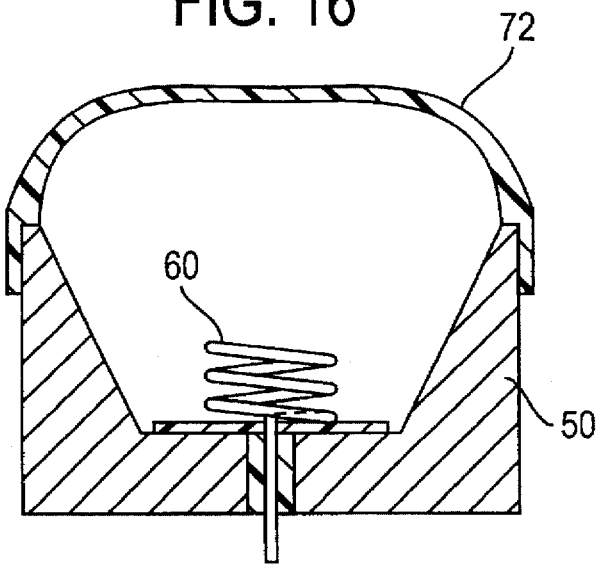
Figure 17:
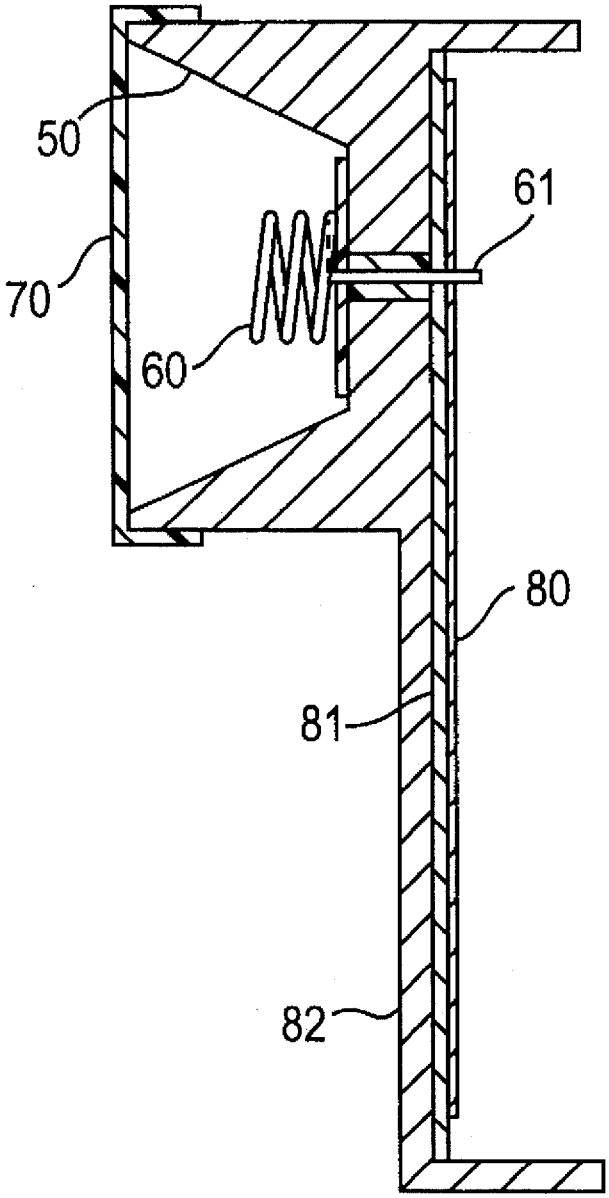
FIG. 17 is a cross section of a converter using the conventional feed-horn with a helical antenna element.

FIG. 11 and FIG. 12 depict a mounting procedure of microstrip line 40 disposed on the printed circuit substrate 41 onto a frame 42 in order to form the converter circuit. The frame 42 and waveguide 6 unite to form one body. First, as shown in FIG. 11, while depressing the bent segment 12 of helical element 11 with a specified jig from the lefthand side in the FIG. 11, the straight line segment 13 is inserted and fixed to the dielectric supporter 14. Second, the printed circuit substrate 41 on which the microstrip line 40 is formed is inserted into the frame 42 from the top in FIG. 11. Then, as shown in FIG. 12, the printed circuit substrate 41 is slid toward left, or toward the helical element 11. Finally, the straight-line segment 13 is soldered to the micro-strip line 40 in order to have electrical connection. A length of frame 42 is longer by a specified length than the total length of the printed circuit substrate 41 and the connected part of straight-line segment 13. Accordingly, the helical element 11 and micro-strip line 40 can be connected to form one straight line by sliding the printed circuit substrate 41.

Through the above procedure, the helical element 11 is connected to the microstrip line 40 constructing the converter circuit to form one straight line, or, the helical element 11 and the printed circuit substrate 41 are arranged to form one straight line, and thereby a converter having straight structure can be formed. As a result, miniaturized and light weight converter is realized. At the same time, compatibility with a conventional antenna is maintained. When using this apparatus into other applications, e.g. mounting this apparatus into a dual-beam antenna which receives radio-waves from a plurality of satellites simultaneously, the radio-waves from the satellites are not interrupted and also interference by blocking can be reduced.

The waveguide, having a round cross sectional shape, in the feed-horn is explained above; however, the present invention is not limited to these embodiments, and the cross sectional shape of waveguide may be oval, rectangular, or other shapes. In the embodiment using step-formed inside in waveguide, the number of steps is not limited to one step, but it may two steps or more. The ring-wise groove, the corrugated circuit, is not limited to a cylindrical groove, but it may be oval or rectangular groove. Therefore, any variations within the scope and spirit of this invention are included in the scope of the claims.

What is claimed is:

1. A feed-horn with a helical antenna element comprising:

a waveguide comprising a cylindrical conductor having a step inside, wherein a diameter in the vicinity of an opening face of said waveguide is larger than a diameter in the vicinity of a base of said waveguide, a helical antenna element disposed at the center of said base, and a cap closing said opening face, said cap being made of a dielectric material and having a concaved face of which the top is protruded toward said base and is located under said opening face.

2. The feed-horn with a helical antenna element of claim 1, wherein said concaved face is a multi-level concaved face having different curvatures.

3. The feed-horn with a helical antenna element of claim 1 including a groove disposed on said cylindrical conductor along outer circumference of said opening face.

4. The feed-horn with a helical antenna element of claim 3, wherein said groove has a cross sectional shape where groove width tapers toward a depth direction.

5. A converter comprising:

a feed-horn with a helical antenna element comprising a waveguide comprising a cylindrical conductor having a step inside, wherein a diameter in the vicinity of an opening face of said waveguide is larger than a diameter in the vicinity of a base of said waveguide, a helical antenna element disposed at the center of said base, and a cap closing said opening face, said cap being made of a dielectric material and having a concaved face of which the top is protruded toward said base and is located under said opening face, and a micro-strip line electrically connected to a straight-line segment of said helical antenna element.

6. The converter of claim 5, wherein said concaved face is a multi-level concaved face having different curvatures.

7. The converter of claim 5 including a groove disposed on said cylindrical conductor along outer circumference of said opening face.

8. The converter of claim 7, wherein said groove has a cross sectional shape where groove width tapers toward a depth direction.

* * * * *